US008684452B2

(12) United States Patent
Lin et al.

(10) Patent No.: US 8,684,452 B2
(45) Date of Patent: Apr. 1, 2014

(54) HIGH-SEAT FOLDING CHAIR HAVING FOOTREST

(76) Inventors: Mei Chuen Lin, Taoyuan Hsien (TW); Tzu Mei Wang, Taoyuan Hsien (TW)

( * ) Notice: Subject to any disclaimer, the term of this patent is extended or adjusted under 35 U.S.C. 154(b) by 0 days.

(21) Appl. No.: 13/303,521

(22) Filed: Nov. 23, 2011

(65) Prior Publication Data

US 2013/0127223 A1 May 23, 2013

(51) Int. Cl.
*A47C 7/50* (2006.01)

(52) U.S. Cl.
USPC ..... 297/76; 297/423.1

(58) Field of Classification Search
USPC ..... 297/423.1, 16.1, 55, 56, 30, 76, 423.25, 297/423.34, 423.22, 423.26, 423.28
See application file for complete search history.

(56) References Cited

U.S. PATENT DOCUMENTS 1,587,253 A * 6/1926 Tarbox ..... 297/35
2,503,942 A * 4/1950 Engelberg et al. ..... 297/70
2,546,765 A * 3/1951 McKinley ..... 297/344.19
2,717,630 A * 9/1955 Dowler ..... 297/30
3,094,357 A * 6/1963 Shwayder ..... 297/452.42
3,224,530 A * 12/1965 King et al. ..... 182/33
3,227,243 A * 1/1966 Bates et al. ..... 182/156
3,649,074 A * 3/1972 McDonald et al. ..... 297/153
4,844,537 A * 7/1989 Reed ..... 297/174 R
5,064,243 A * 11/1991 Quain ..... 297/58
D365,936 S * 1/1996 Haut et al. ..... D6/339
5,609,390 A * 3/1997 Takafuji ..... 297/55
6,478,375 B2 * 11/2002 Richardson ..... 297/248
6,533,360 B1 * 3/2003 Parkel et al. ..... 297/423.28
7,226,123 B1 * 6/2007 Lin et al. ..... 297/56

* cited by examiner

*Primary Examiner* — David R Dunn
*Assistant Examiner* — Richard Lowry
(74) *Attorney, Agent, or Firm* — Rabin & Berdo, P.C.

(57) ABSTRACT

A high-seat folding chair includes two pairs of front legs and rear legs pivotally connected with each other so as to be operable to unfold or fold the folding chair. When unfolded, each of the front legs and the rear legs form an angle relative to a horizontal plane. A footrest is mounted between the two front legs. Two opposite portions of the footrest bend symmetrically in a horizontal direction to form horizontal portions, respectively. The two horizontal portions further bend upward to form inclined extensions, and a portion of each inclined extensions forms a flat portion. An angle defined between the inclined extension and the horizontal portion is equal to an angle defined between the front leg and the horizontal plane. The inclined extensions of the footrest are respectively affixed with the two front legs, such that the footrest is mounted in horizontal.

1 Claim, 5 Drawing Sheets

HIGH-SEAT FOLDING CHAIR HAVING FOOTREST

BACKGROUND OF THE INVENTION

1. Field of the Invention

The present invention relates to a high-seat folding chair, and in particular to a high-seat folding chair having a footrest.

2. The Prior Arts

Bar stools are usually used to sit by a bar table. The bar stools may include a single leg or multiple legs to support the seat and the leg has a length larger than that of the conventional chairs. The bar stool may also have a footrest on which a user may place the feet for comfortable sitting.

Due to the footrest, the conventional bar stool usually adopts a round design. In other words, the seat has a circular shape and the footrest is also circular. As a result, the conventional bar stool cannot be folded. Thus, it is inconvenient to store when it is not in use.

SUMMARY OF THE INVENTION

A primary objective of the present invention is to provide a chair that has a high seat and a footrest for comfortable seating and can be folded for convenient storage when unused.

Another objective of the present invention is to provide a high-seat folding chair having a footrest that has a high strength structure and is not easily damaged in use.

In order to achieve the objectives, a high-seat folding chair according to the present invention includes two pairs of front legs and rear legs that cross and pivotally connect with each other. Thus, the front legs and rear legs are operable to unfold or fold relative to each other. When unfolded, the front legs and the rear legs form an angle relative to a horizontal plane.

The footrest according to the present invention is assembled between the two front legs. Two ends of the footrest bend symmetrically in a horizontal direction to form horizontal portions, respectively. The two horizontal portions further bend upward to form inclined extensions, and a portion of each inclined extension forms a flat portion. An angle defined between the inclined extension and the horizontal portion is equal to an angle defined between the front leg and the horizontal plane. The inclined extensions of the footrest are respectively fixed with the two front legs, such that the footrest is mounted in the horizontal.

To reinforce the strength of the legs, each of the front legs has an outer surface provided with a slot that extends along the two front legs. The shape of the slot defined between two flanges can improve the mechanical strength of the front legs. Furthermore, a bottom surface of each slots comprises a through hole and the flat portion of the footrest has a hole corresponding to the through hole. A fastener element passes through the hole of the footrest and the through hole of the front leg to fix the footrest with the front legs.

The present invention can use bolt-nut assemblies to engage the through holes of the front legs with the holes of the footrest to fix the footrest and the front legs together. Alternatively, rivets can also be used to engage the through holes of the front legs with the holes of the footrest to affix the footrest with the front legs.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENTS

Figure 1:
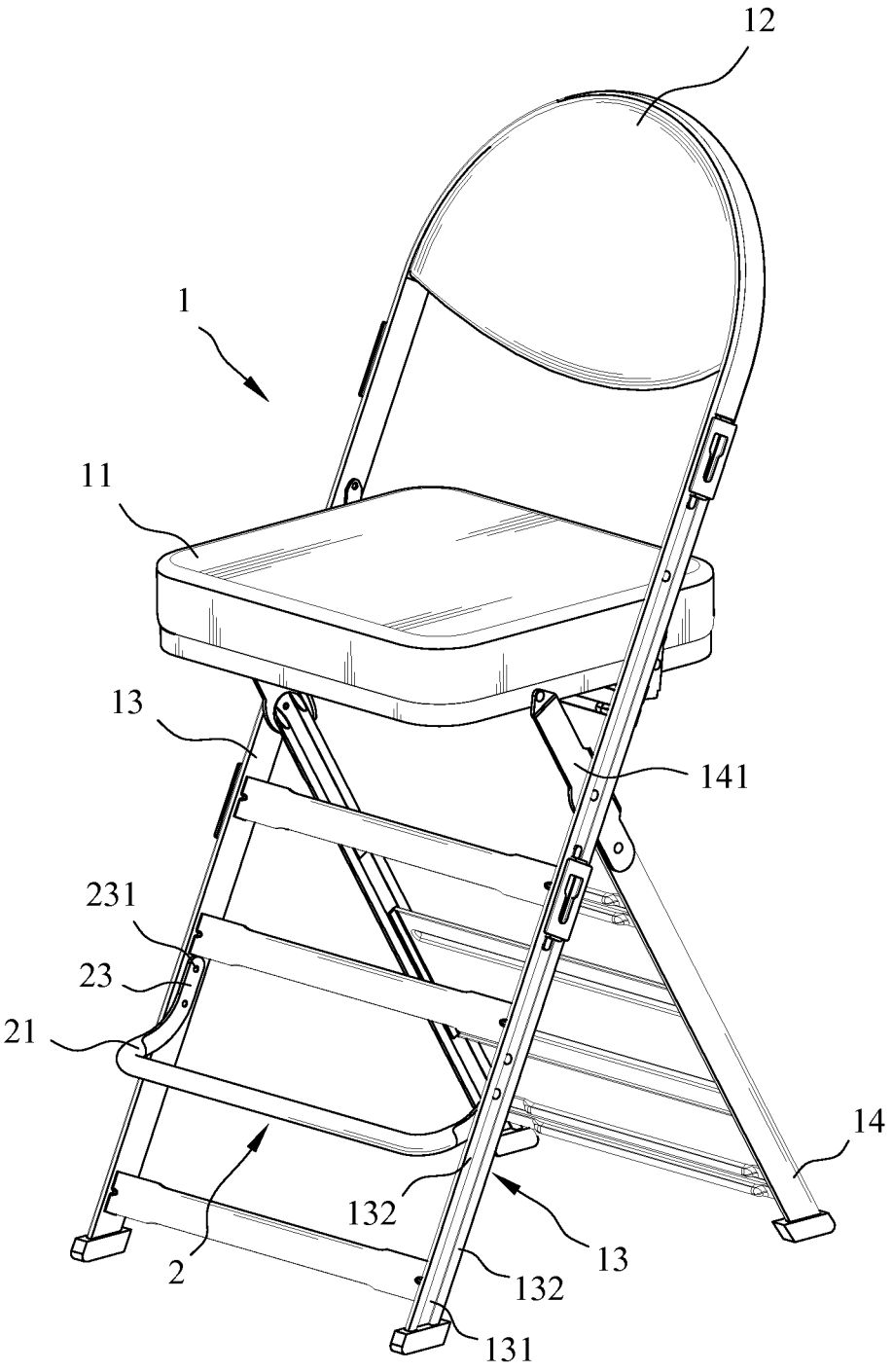
FIG. 1 is a perspective view showing a high-seat folding chair having a footrest according to an embodiment of the present invention.
Figure 2:
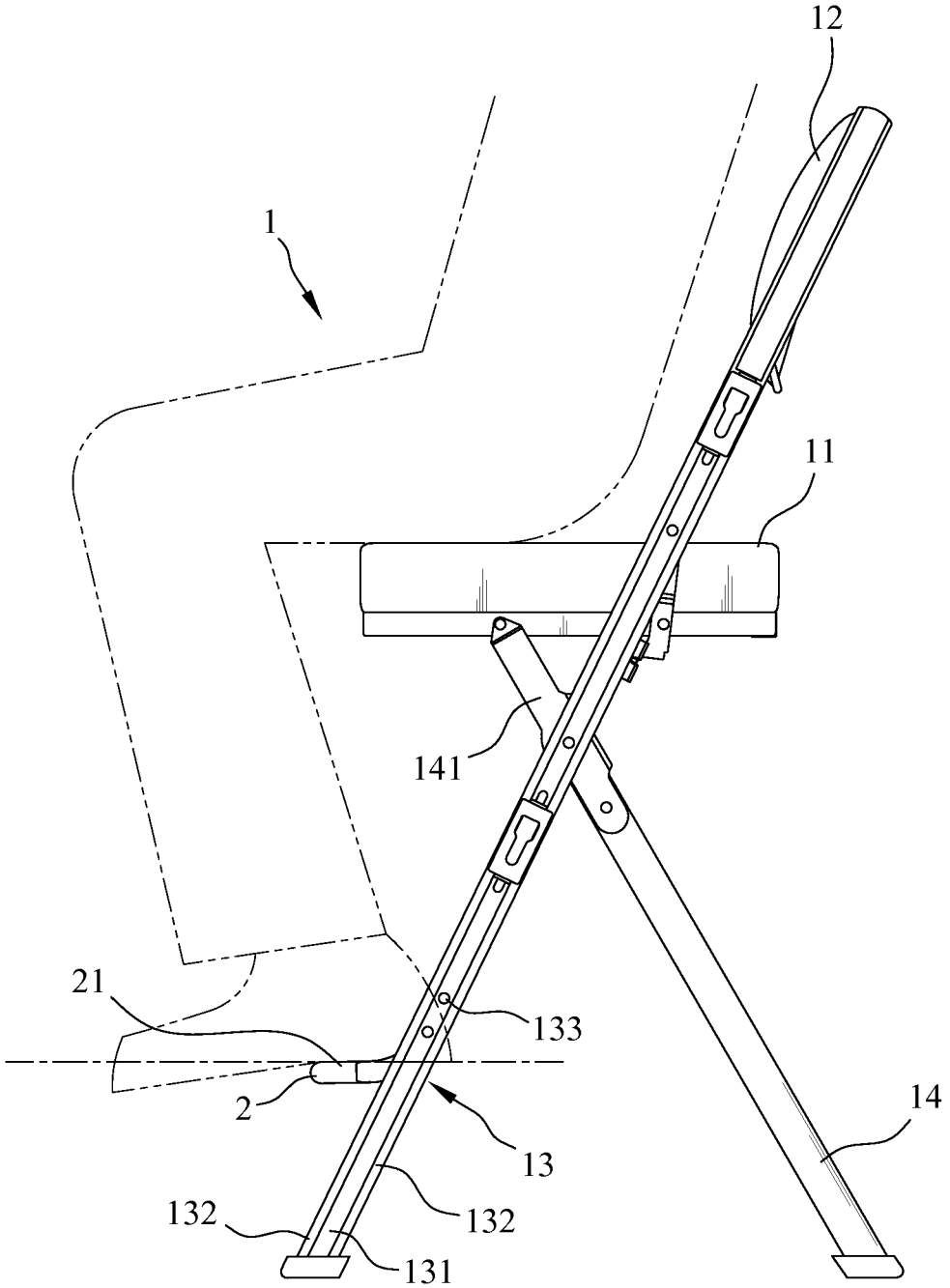
FIG. 2 is a side view showing the folding chair according to the present invention.

As shown in FIGS. 1 and 2, a high-seat folding chair 1 according to the present invention comprises two pairs of front legs 13 and rear legs 14 that cross and pivotally connect with each other so as to be operable to unfold or fold relative to each other. A seat 11 is pivotally connected with upper portions of the front legs 13 and upper ends of the rear legs 14, such that the seat 11 can rotate relative to the front legs 13 and the rear legs 14 to either fold the folding chair into a flat state or unfold it for use. Each rear leg 14 is connected with the seat 11 through a large support piece 141, which can reinforce the overall structure. The upper portions of the front legs 13 extend upward, and a seatback 12 is mounted between the front legs 13. When the legs 13 and 14 are unfolded relative to each other, each of the front legs 13 and the rear legs 14 form an angle relative to a horizontal plane. In order to reinforce the strength of the legs, the front leg 13 according to a preferred embodiment of the present invention includes a slot 131 that is extended along the front leg 13 lengthwise and disposed at an outer surface of the front leg 13. Both sides of the slot 131 include flanges 132. The slots 131 and flanges 132 can improve the mechanical strength of the front legs 13. The front leg 13 can be formed by a drawing process, or by bending of a metal strip to provide good mechanical properties. A bottom surface of the slot 131 comprises a plurality of through holes 133.

Figure 3:
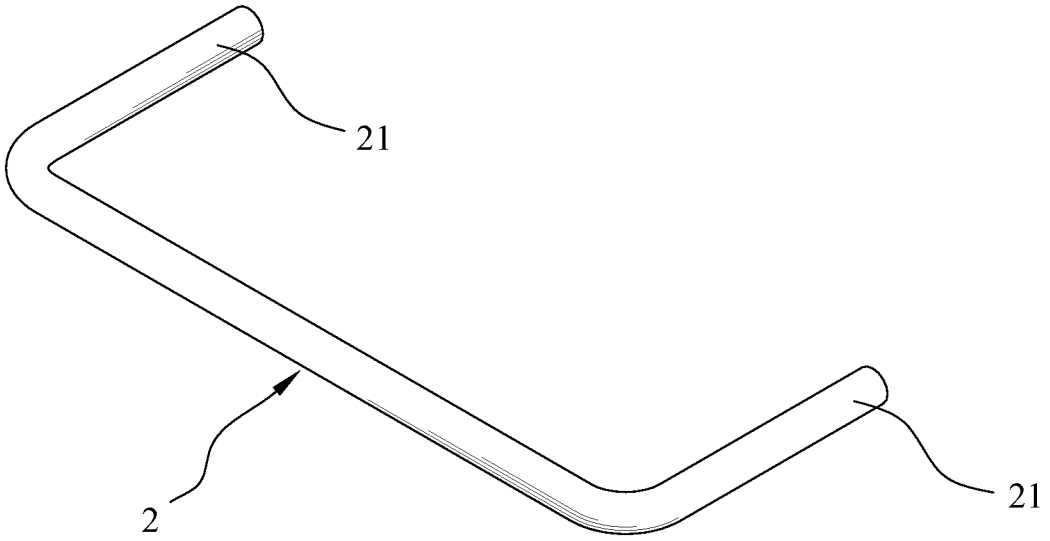
FIGS. 3 to 5 are perspective views showing the processes to form the footrest according to the present invention.
Figure 4:
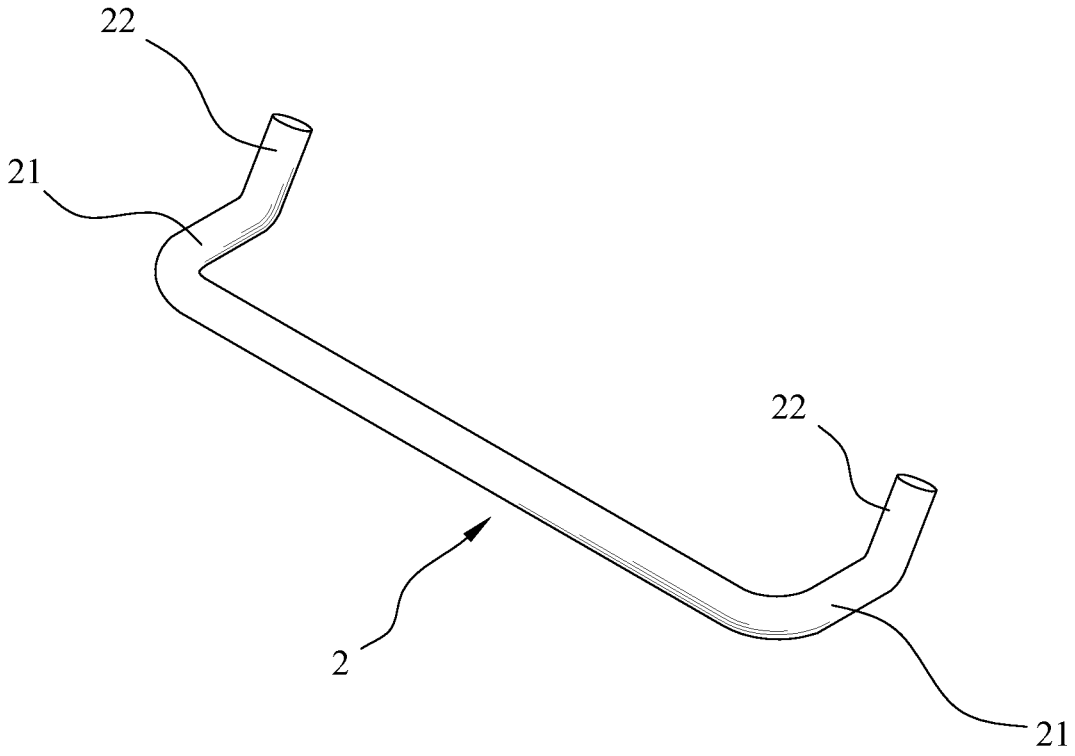
Figure 5:
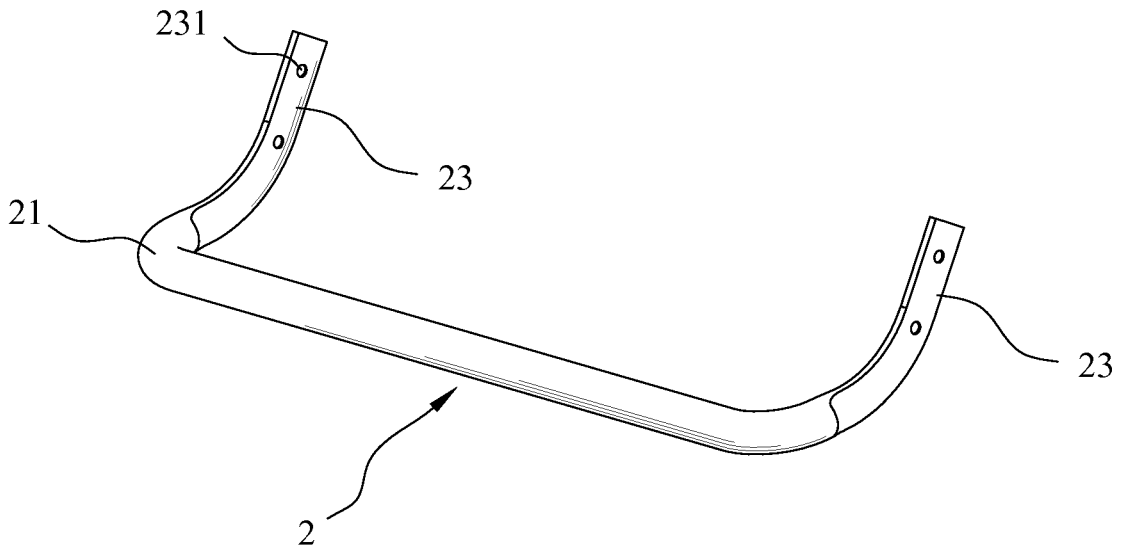

According to a preferred embodiment of the present invention, a footrest 2 is formed by a metal tube. FIGS. 3 to 5 are perspective views showing the processes to form the footrest 2. Referring to FIG. 3, two opposite portions of the footrest 2 bend symmetrically in a horizontal direction to form horizontal portions 21, respectively. Referring to FIG. 4, the two horizontal portions 21 further bend upward in a predetermined angle to form inclined extensions 22, respectively. Referring to FIG. 5, a portion of each inclined extension 22 is pressed to form a flat portion 23. Preferably, the flat portion 23 is formed by forging to provide improved mechanical properties to the footrest 2. The angle defined between the inclined extension 22 and the horizontal portion 21 is equal to the angle defined between the front leg 13 and the horizontal plane. The flat portion 23 further comprises a plurality of holes 231 corresponding to the through holes 133 of the front leg 13.

When assembling the footrest 2 with the high-seat folding chair 1, the two flat portions 23 disposed at the two sides of the footrest 2 are placed adjacent to the inner side of the two front legs 13, such that the through holes 133 of the front legs 13 are aligned with the holes 231 of the flat portions 23. Then a fastener element engages each hole 231 with the corresponding through hole 133 to securely fix the footrest 2 with the front legs 13. The fastener element can be a bolt-nut assembly. In particular, the bolt passed through the hole 231 and through hole 133, and the nut is then engaged with the bolt. Alternatively, rivets can also be engages the hole 231 with the through hole 133 to affix the footrest 2 with the front legs 13. Once the footrest 2 is assembled to the front legs 13, the flat portions 23 are parallel to and aligned with the front legs 13 and the footrest 2 is generally parallel to the horizontal plane as shown in FIG. 2.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A high-seat folding chair having a footrest, comprising:

two pairs of front legs and rear legs that cross and pivotally connect with each other at a pivot so as to be operable to unfold or fold relative to each other, and when unfolded, each of the front and rear legs forms an angle relative to a horizontal plane; and a footrest disposed between the two front legs and being fixed to the two front legs at a position below the pivot, the footrest being immovable relative to the two front legs, the footrest being formed from a metal tube, two opposite portions of the footrest respectively bend symmetrically in a horizontal direction to form horizontal portions, the horizontal portions and a front portion of the footrest being tubular, the two horizontal portions further bend upward to form inclined extensions, a portion of each of the inclined extensions forms a flat portion, an angle defined between the inclined extension and the horizontal portion is equal to an angle defined between the front legs and the horizontal plane, and the inclined extensions of the footrest are respectively fixed with the two front legs;

wherein each of the front legs has an outer surface provided with a slot that extend along the front legs, a bottom surface of the slot comprises a through hole, the flat portion of the footrest has a hole corresponding to the through hole of the front leg, and a fastener element engages the hole with the through hole to fix the footrest with the front legs.

* * * * *